US005944141A

United States Patent [19]

Kochan et al.

[11] Patent Number: 5,944,141

[45] Date of Patent: Aug. 31, 1999

[54] FOLDABLE LADDER

[75] Inventors: Brian Kochan, Edmonton; George W. Thorpe, Calgary, both of Canada

[73] Assignee: Gerald R. Kendall and Edward J. Green, Calgary, Canada

[21] Appl. No.: 08/836,747

[22] PCT Filed: Sep. 18, 1996

[86] PCT No.: PCT/CA96/00615

§ 371 Date: Jun. 12, 1997

§ 102(e) Date: Jun. 12, 1997

[87] PCT Pub. No.: WO97/11248

PCT Pub. Date: Mar. 27, 1997

Related U.S. Application Data

[63] Continuation-in-part of application No. 08/530,039, Sep. 19, 1995, abandoned.

[51] Int. Cl.[6] ..... E06C 1/52

[52] U.S. Cl. ..... 182/163; 182/159

[58] Field of Search ..... 182/163, 165, 182/164, 156, 159, 160

[56] References Cited

U.S. PATENT DOCUMENTS

| | | | |
|---|---|---|---|
| 2,183,251 | 12/1939 | Beggs . | |
| 2,461,429 | 2/1949 | Larson . | |
| 3,042,143 | 7/1962 | Silen . | |
| 3,081,840 | 3/1963 | Hire . | |
| 3,216,526 | 11/1965 | Cole | 182/163 |
| 3,286,789 | 11/1966 | Planchon . | |
| 3,730,295 | 5/1973 | Deese . | |
| 3,744,591 | 7/1973 | Lucci . | |
| 3,861,499 | 1/1975 | Follett . | |
| 4,002,223 | 1/1977 | Bernkrant . | |
| 4,531,613 | 7/1985 | Keigher . | |
| 4,712,756 | 12/1987 | Kester . | |

FOREIGN PATENT DOCUMENTS

| | | |
|---|---|---|
| 0 263 628 | 4/1988 | European Pat. Off. . |
| 0 431 221 | 6/1991 | European Pat. Off. . |
| 0 607 740 | 7/1994 | European Pat. Off. . |
| 1 426 678 | 4/1966 | France . |
| 944 457 | 6/1956 | Germany . |
| 31 47 306 | 6/1983 | Germany . |
| 2 137 681 | 10/1984 | United Kingdom . |

*Primary Examiner*—Alvin Chin-Shue
*Attorney, Agent, or Firm*—Bennett Jones

[57] ABSTRACT

A foldable ladder having rungs pivotally connected to the side rails, allowing the side rails to pivot from a position wherein the siderails are coplanar to the rung to a support position wherein the side rails are normal to the rungs.

15 Claims, 9 Drawing Sheets

FOLDABLE LADDER

This is a continuation-in-part of application Ser. No. 08/530,039 filed on Sep. 19, 1995, now abandoned.

FIELD OF THE INVENTION

This invention relates to a ladder and, in particular, to a ladder which can be folded for storage.

BACKGROUND OF THE INVENTION

Foldable ladders are known which can be folded for storage in small spaces such as trunks of cars or closets. These ladders generally allow a ladder to be folded to about 36 inches in length. Such ladders are extended into straight, rigid form for use. Foldable ladders are often dangerous in that they can move between a rigid position and a collapsible position relatively easily. In addition, the folding nature of the ladders can render them of insufficient strength, when extended, to support the weight of a person.

Any ladder construction should be as simple as possible, to cause the cost of the ladder to be reasonable.

SUMMARY OF THE INVENTION

A ladder is provided which can be folded for storage and extended into rigid form for use. The inventive ladder is resistant to inadvertent collapse during use and is of sufficient strength to maintain its rigid form while supporting weight.

According to a broad aspect of the present invention there is provided a ladder comprising a pair of side rails and a plurality of rungs, a pivotal attachment being positioned between each rung and each of the side rails such that the side rails are free to rotate from positions substantially coplanar with the rungs to positions defining a plane substantially normal to the rungs to support the rungs, the pivotal attachment between the rungs and side rails being disposed to permit relative rotation of the side rails not more than 90° from the position substantially coplanar to the rungs, and the side rails being formed in segments pivotally attached at their ends such that the side rails can be folded into an accordion arrangement.

DESCRIPTION OF THE INVENTION

The present inventive ladder can be folded into an accordion arrangement by having side rails formed as segments which collapse about pivotal connections disposed along the side rails. The pivotal connections are spaced longitudinally along the side rails and in corresponding locations on each side rail so that the two side rails can fold simultaneously. The pivotal connections are of any suitable type. Preferably, pivotal connections are provided having a suitable tolerance to accommodate weight placed on the ladder. In one embodiment the pivotal connections are in the form of double hinges. Double hinges allow ease of manufacture and strengthen the ladder. The double hinges can be formed by placing a u-shaped member between abutting ends of the side rails. The double hinges can alternatively be formed by placing a pair of links between the ends. Where the rail segments are hollow, plate or block inserts formed of suitable material, such as for example, steel or plastic, can be used to reinforce the pivotal connections. It has been found that a plastic insert acts to retain the tightness of the pivotal connection over a greater period of time, as compared to steel, and is therefore preferred.

In a preferred embodiment, the side rails are formed as two foot long sections with a single hinge at each end. The sections are manufactured in one piece by molding a high strength material such as plastic, fibre reinforced plastic or injectable metals. A preferred length for the side rail segments is twenty four (24) inches, however a twelve (12) inch length can be used in some embodiments. The hinges at the ends of the side rails in this preferred embodiment are formed to join the abutting ends of the rails directly. In a preferred embodiment, the hinges are formed as a plurality of ribs extending outwardly and upwardly from the ends of the segments. Apertures are disposed through the ribs for accepting a pin about which the segments can pivot.

The segments of the side rails are free to collapse about the pivotal connections when the ladder is disposed in a flat position wherein the rungs and side rails are in a single plane. When the ladder is prepared for use, the side rails are rotated about 90° to each define a plane normal to the plane of the rungs. As such the side rails are placed into abutting relation with the front or back of the rungs. In such an arrangement, the corresponding hinges of the side rails are in opposing position such that the segments of the side rails are prevented from collapsing about their pivotal connections to fold the ladder. The rotation of the side rails about the rungs is provided by pivotal connections positioned between the side rails and the rungs. The pivotal connections are positioned such that the side rails can rotate substantially only about 180° between abutting relation on the front face through the plane defined by the rungs and into abutting relation with the back face of the rungs. In a preferred embodiment, pivotal connections are provided which permit the rotation of the side rails substantially only about 90° in opposite directions relative to the rungs to a selected one of the back or front of the rungs, such that inadvertent placement of the pivotal connections of the side rails into position where they can collapse is prevented. Rotation of the side rails beyond 90° is prevented in a first direction by the abutment of the side rails against the rungs. Rotation in the second direction is prevented by means associated with the pivotal connection such as by an abutting wall or flange. Thus, inadvertent rotation of the side rails into collapsible position by torsional forces during use is prevented. Since the rails rotate in opposite directions to abut the rungs, one side rail will always, by abutment against the rungs, resist the torsional force which tends to rotate the side rails into collapsible position.

The hinges for connecting the side rails to the rungs preferably are formed integral with side rail and rungs to facilitate manufacture.

In a preferred embodiment, also to prevent inadvertent rotation of the side rails into a collapsible position, a lock is provided between at least one rung and a side rail. In one embodiment, the lock is a flange, extending out from the side rail, which is engaged by a sliding sleeve on the rung. In another embodiment, the lock is a hooked clip extending out from the side rail which engages in an indentation formed on the rung.

The ladder is preferably formed of lightweight and high strength material such as polymeric, fibre reinforced polymeric or injectable metal materials. In a one embodiment, the side rails and rungs are formed of extruded aluminum. In this embodiment, the side rails and rungs are preferably formed to have inner longitudinally extending channels for engaging adapters useful for reinforcement of the pivotal connections. In another embodiment, the ladder is molded from polymeric materials such as structural foam ABS.

BRIEF DESCRIPTION OF THE DRAWINGS

A further, detailed, description of the invention briefly described hereinbefore will follow by reference to the following drawings of specific embodiments of the invention. These depict only typical embodiments of the invention and are therefore not to be considered limiting of its scope. In the drawings.

DETAILED DESCRIPTION OF THE INVENTION

Figure 1A:
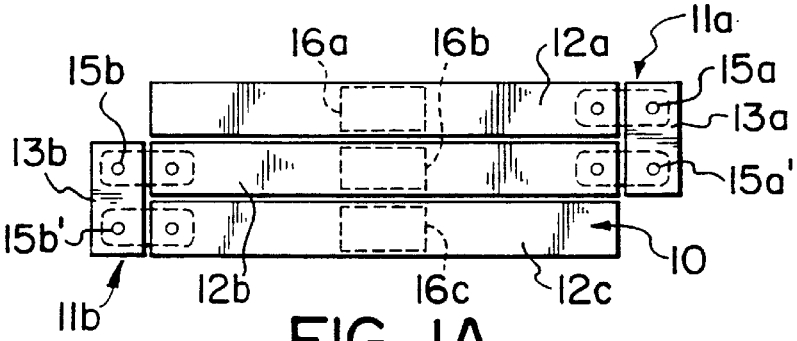
FIG. 1A shows a side view of one embodiment of a ladder according to the present invention in folded arrangement.
Figure 1B:
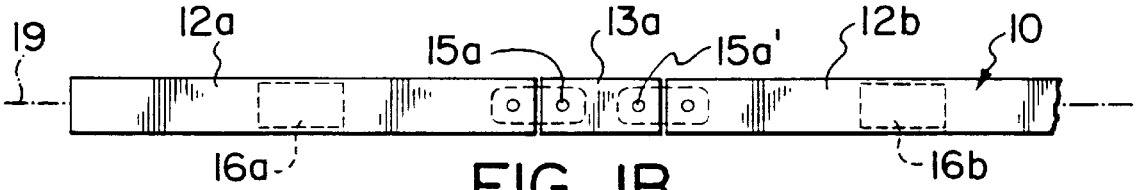
FIG. 1B shows a side view of the ladder of FIG. 1A in flat arrangement.
Figure 1C:
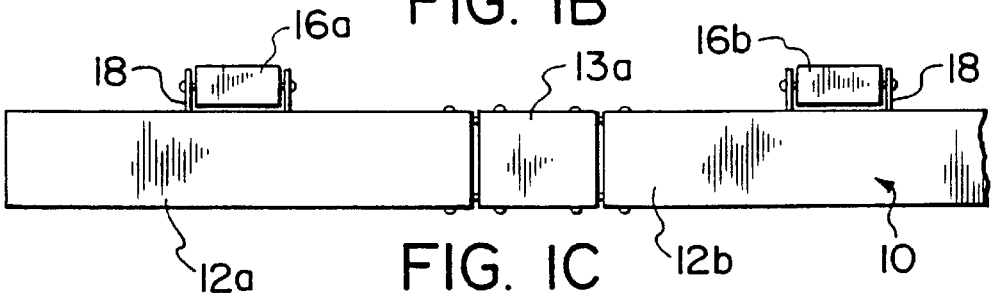
FIG. 1C shows a side view of the ladder of FIG. 1A in position for use.
Figure 2A:
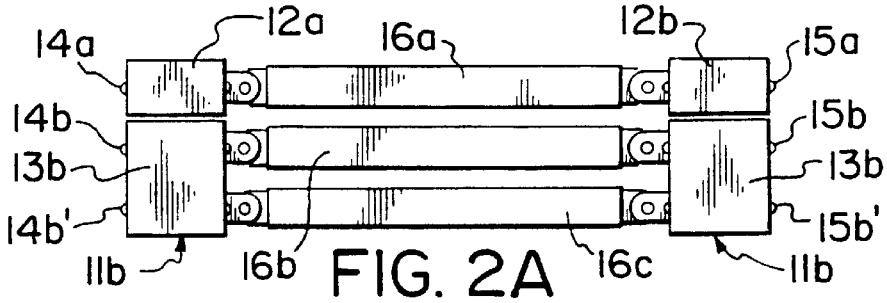
FIGS. 2A, 2B and 2C show end views of the ladder as shown in FIGS. 1A, 1B and 1C, respectively.
Figure 2B:
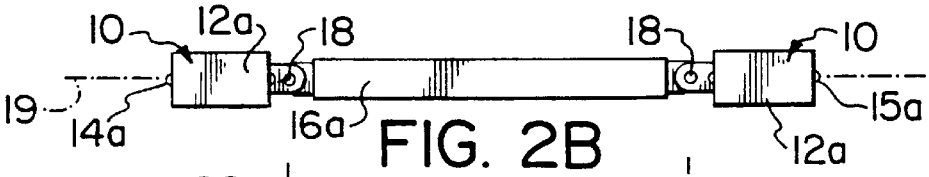
Figure 2C:
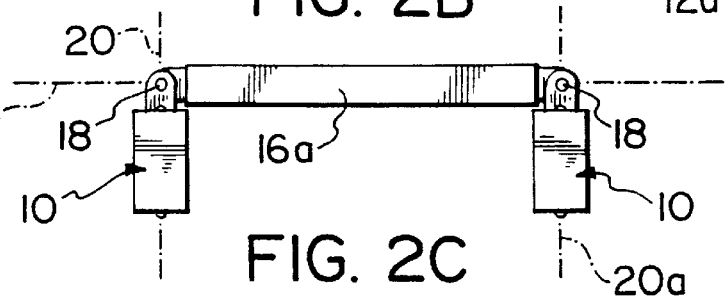
Figure 3:
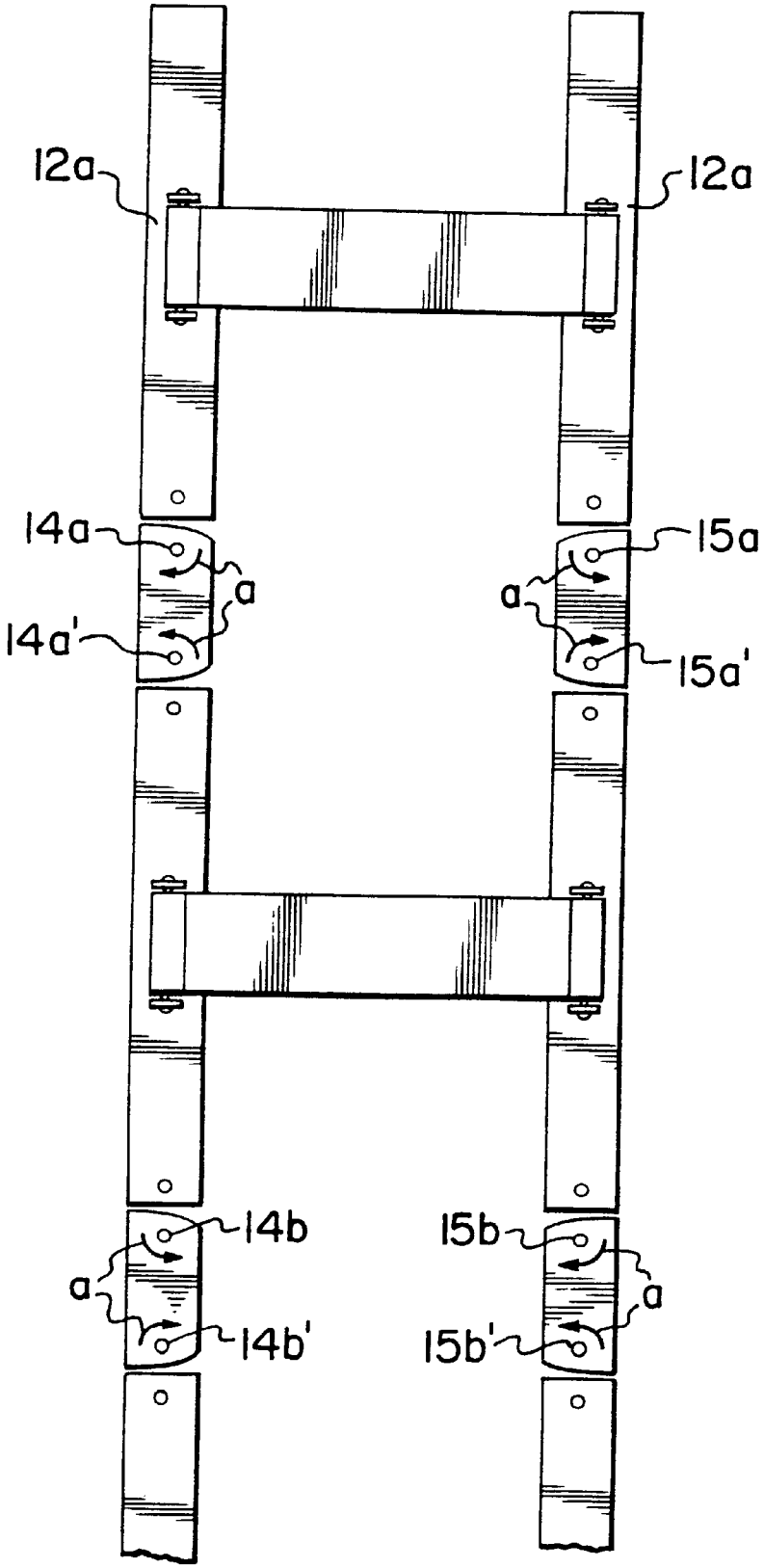
FIG. 3 shows a plan view of the ladder as shown in FIGS. 1C and 2C.

Referring to FIGS. 1A, 1B, and 1C and corresponding FIGS. 2A, 2B, 2C and 3, the inventive ladder can be arranged between a folded position as shown in FIGS. 1A and 2A, for storage, and an extended, rigid position for use as shown in FIGS. 1C, 2C and 3.

The side rails 10 of the ladder are formed as segments 12*a*, 12*b*, 12*c*. Segments 12*a*, 12*b*, and 12*c* are pivotally attached at their ends by means of double hinge arrangements 11*a*, 11*b*. The double hinge arrangements are formed by intermediate members 13*a*, 13*b*, which attach segments 12*a*, 12*b*, and 12*c* such that they are able to be rotated simultaneously about pivot points 14*a*, 14*a*', 14*b*, 14*b*', 15*a*, 15*a*', 15*b* and 15*b*'. (Pivot points 14*a*, 14*a*', 14*b*, 14*b*' are disposed behind pivot points 15*a*, 15*a*', 15*b*, 15*b*' in FIGS. 1A–1C). A plurality of rungs 16*a*, 16*b*, and 16*c* (shown in phantom in FIGS. 1A, 1B and 1C) are pivotally connected between side rails 10 by means of single hinges 18 disposed at each end of each rung. Any number of segments and rungs can be used in combination.

To prepare the ladder for use, side rail segments 12*a*, 12*b*, and 12*c* are unfolded and arranged longitudinally into flat arrangement, as shown in FIGS. 1B and 2B, such that the side rails and the rungs are in substantially the same plane, as indicated in phantom at 19. In this position, segments 12*a*, 12*b*, 12*c* are free to rotate about pivot points 14*a*, 14*a*', 14*b*, 14*b*', 15*a*, 15*a*', 15*b* and 15*b*'.

To render the ladder suitable for use in supporting weight, side rails 10 are rotated 90° in opposite directions about hinge connections 18 such that the side rails are in parallel planes 20, 20*a* normal to plane 19, as shown in FIGS. 1C, 2C and 3. When side rails 10 are rotated in this way the segments on opposite side rails could only fold if they were able to pivot in opposite directions as indicated by arrows a (FIG. 3). Thus, the side rails will be maintained rigid as corresponding pivot points, eg. 14*a* and 15*a*, 14*a*' and 15*a*', 14*b* and 15*b* and 14*b*' and 15*b*', on opposite side rails, cannot fold simultaneously.

The ladder is rendered into a folded position by reversing the unfolding operation.

Figure 4:
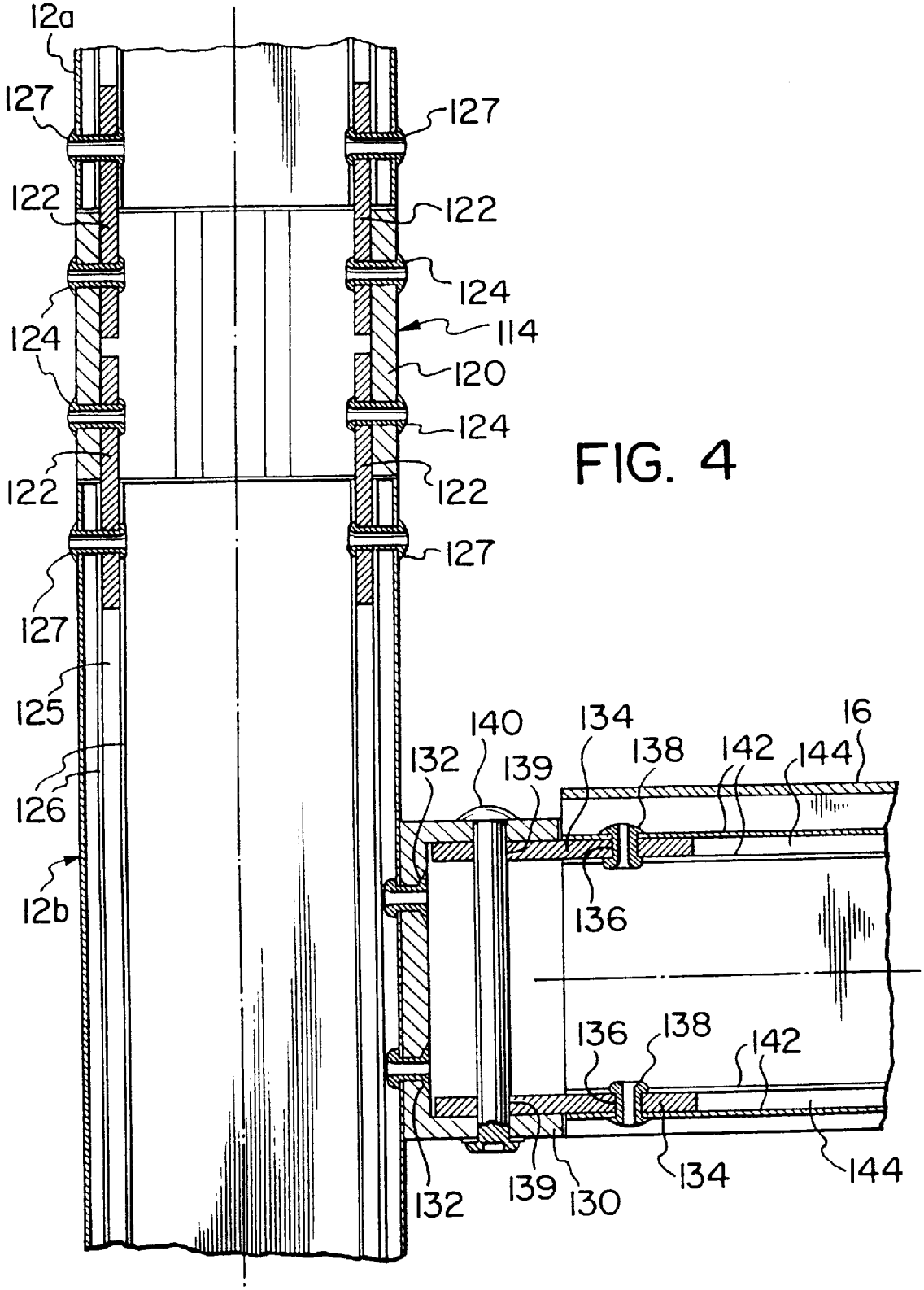
FIG. 4 shows a plan view of the hinge portions of an embodiment of a ladder of the present invention, partly in section.
Figure 5:
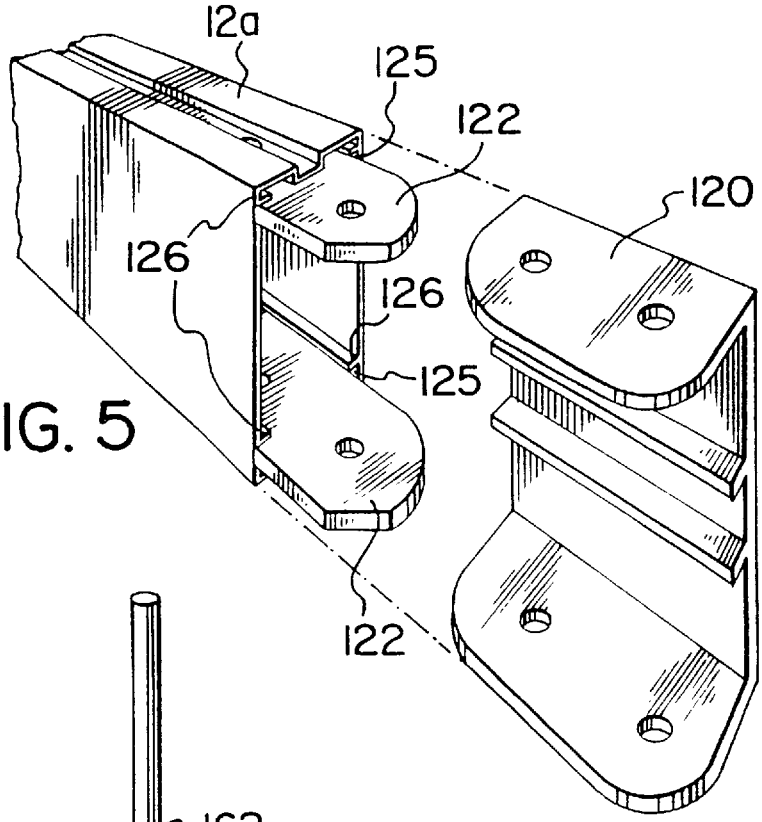
FIG. 5 shows a perspective view of a hinge useful in the present invention.

Referring to FIG. 4, a plan view, partially in section, of a portion of the ladder in flat position is shown. Side rail segments 12*a* and 12*b* are substantially identical in construction and are connected by double hinge 114. Referring also to FIG. 5, the preferred hinge connection includes a u-shaped member 120 which extends between abutting ends of segments 12*a*, 12*b*. The edges of member 120 are curved to permit rotation of the hinge. Member 120 is formed of material such as aluminum or steel having sufficient strength to withstand the force of segments 12*a*, 12*b* acting thereon during use of the ladder. Preferably member 120 is formed of ⅜" to ½" thick aluminum. Member 120 is pivotally connected to an end of each of segments 12*a* and 12*b*.

Preferably, as shown, plate members 122 are inserted between member 120 and each segment 12*a* and 12*b*. Members act as a rigid extension of segments 12*a* and 12*b*, respectively. Plates 122 are pivotally attached to member 120 through pivot points 124, such as rivets (as shown) or a pin. The ends of the plates are curved in plan view to permit rotation about the pivot points 124. Plates 122 are rigidly attached to side rail segments by fasteners 127, such as rivets as shown. Plates 122 are secured to side rail segments 12*a*, 12*b* by insertion into channels 125 formed in the side rails (see FIG. 5). Channels 125 are defined by flanges 126 extending from the inner surface of side rail segments 12*a*, 12*b*.

Flanges 126 can be formed on the side rails by extrusion. Plates 122 are formed of material, such as for example steel, of sufficient strength to withstand stresses about the pivotal connections during use. By use of plates 122, the side rails and rungs can be formed of thin material, such as 1/16" thick aluminum while the pivotal connections are reinforced by the plates.

Figure 6:
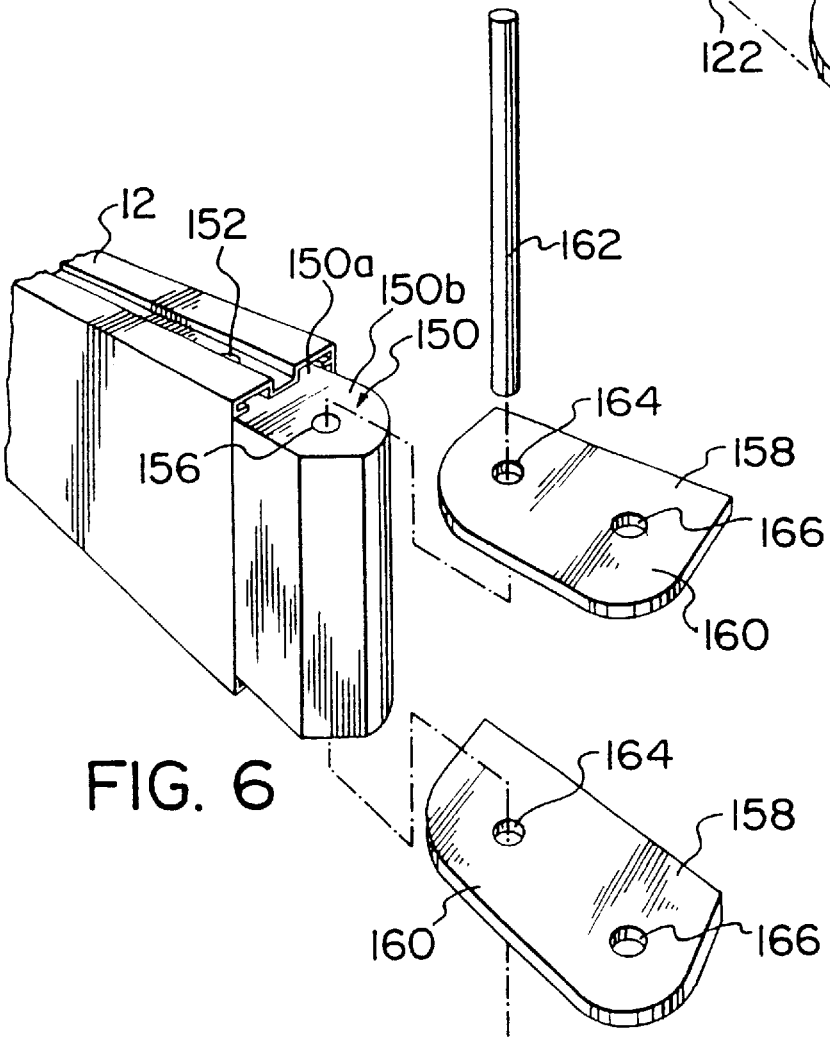
FIG. 6 shows a perspective view of another hinge useful in the present invention.

Referring to FIG. 6, in another hinge connection a block insert 150 is used in place of the plates 122 of FIG. 5. Block insert 150 is formed to have a first end 150*a* which fits into an end of a side rail 12 and a second end 150*b* which extends out from side rail 12. Rivets 152 extend through apertures in side rail 12 to engage insert 150. A bore 156 extends through end 150*b* of insert 150 to accommodate a pin 162, which forms the pivotal connection of the double hinge. Insert 150 is preferably injection molded from a suitable plastic, such as nylon.

A pair of links 158 can be used in place of the member 120 of FIG. 5 to form the double hinge joining side rail segments. Links 158 are attached at the sides of the side rail and extend between abutting ends of the side rail segments (for example 12). The edges of links 158 are curved at a first side 160 to permit rotation of the hinge in one direction. Pin 162 is mounted through apertures 164 in links 158 and bore 156 in insert 150 to provide the pivotal connection of the double hinge. Links 158 are pivotally attached to another side rail segment (not shown), as described, through apertures 166. Links are preferably formed of ⅜" to ½" thick aluminum.

The plates 122 and insert 158 shown in FIGS. 5 and 6, respectively, are interchangeable as are the member 120 and the pair of links 158. Any suitable combination of these elements can be used in the same ladder, if desired.

Referring back to FIG. 4, a bearing member 130 is attached to side rail segment 12*b* for pivotal connection to rung 16. Bearing member 130 is attached to side rail 12*b* by means of rivets 132 or other suitable means such as welds or threaded fasteners. The pivotal connection to rung 16 is through a pair of plates 134 inserted at each end of rung 16. Plates 134 have apertures 136 for accepting rivets 138 for rigid attachment to rung 16 and apertures 139 for accepting a pin 140 for attachment to member 130. Rung 16 has formed on its inner surface upstanding flanges 142 which define channels 144 for insertion of plates 134. Plates 134 can alternately or additionally be held in position in rung 16 by any suitable means, such as means of adhesives, welds or fasteners.

Figure 7:
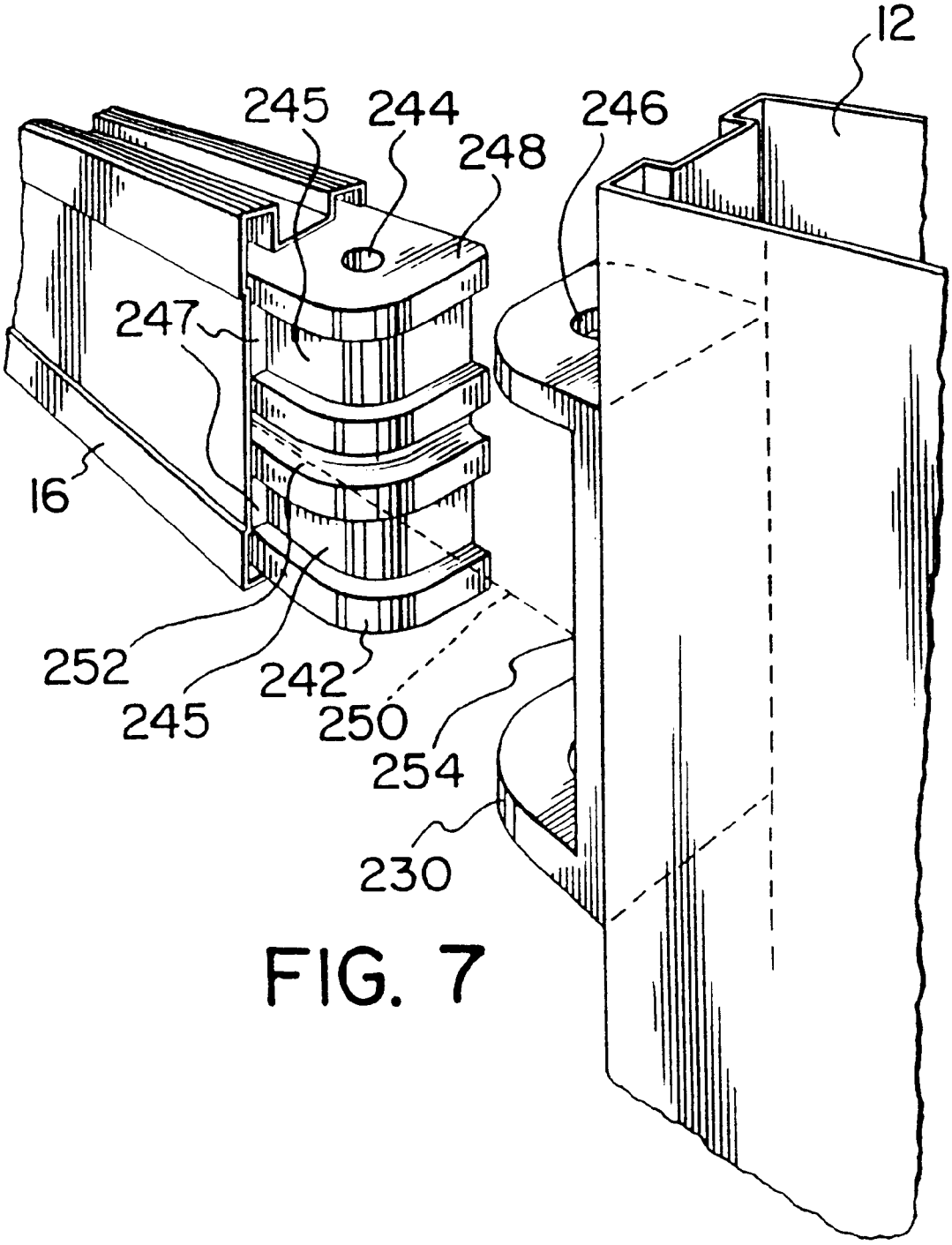
FIG. 7 shows a perspective view of another hinge useful in the present invention.

Referring to FIG. 7, an alternate embodiment of a pivotal connection between a rung 16 and a side rail segment 12 is shown. A insert 242 fits within an end of rung 16 for connection to bearing member 230. A bore 244 formed through insert 242 aligns with apertures 246 of member 230 for accepting a pin (not shown). Insert 242 is preferably formed of injection molded plastic, such as nylon. Preferably, insert 242 is molded with channels 245 which engage ribs 247 on rung 16 to increase rigidity of the structure.

To facilitate rotation of the side rails into position for use, in a preferred embodiment an elastic cord, indicated by phantom line 250, is inserted through rung 16 to extend at each end in groove 252 of insert for attachment, under tension, to side rail segment 12, generally at 254. The tension of elastic cord 250 acts to cause the side rail to be drawn up into position for use when the ladder is unfolded into a flat position.

In the preferred embodiment, rung and side rail pivotal connections are disposed to rotate only about 90° with respect to each other. Referring to FIG. 7, for example, insert 242 is formed at its end to allow rotation only in one direction, while rotation in the alternate direction is prevented by a corner portion 248 formed on insert 242. Rotation can also be prevented by providing other means such as a side wall on member 230. Such means act to prevent the side rails from being rotated into collapsible position during use.

Figure 8A:
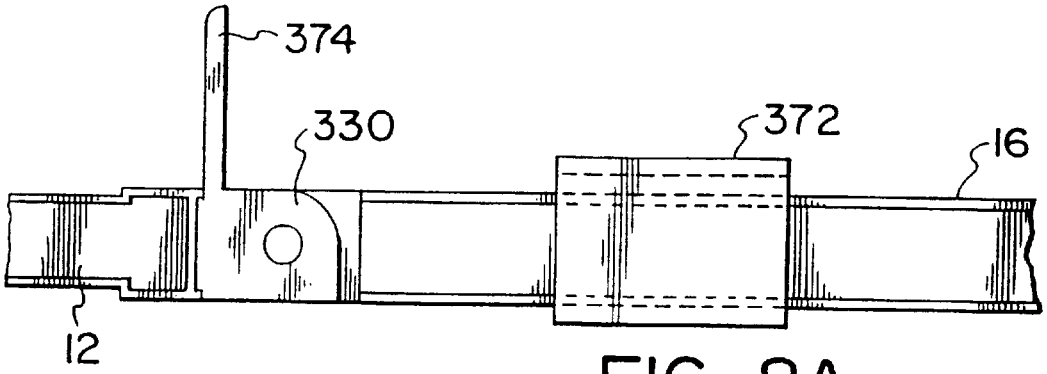
FIG. 8A shows an end view of a ladder of the present invention having a lock arrangement, the ladder being in a flat arrangement.
Figure 8B:
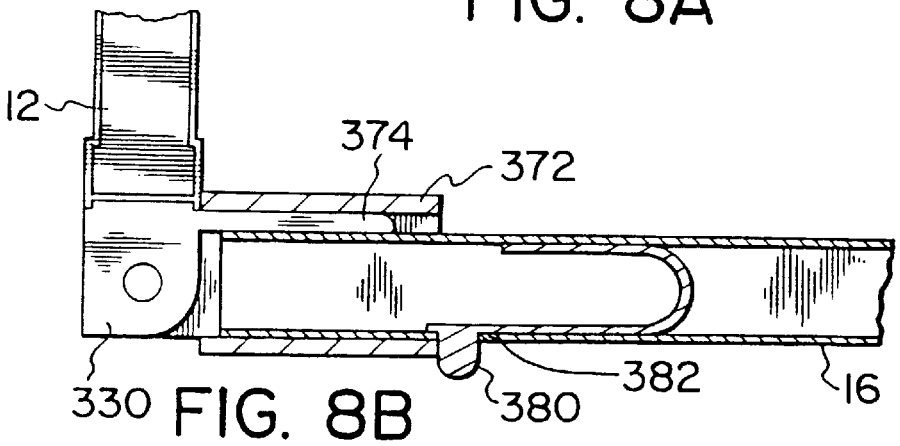
FIG. 8B shows an end view, partly in cross section, of the ladder of FIG. 8A in a position for use.

Referring to FIG. 8A and 8B, to further prevent the inadvertent rotation of the side rails into collapsible position during use, a lock is preferably provided between at least one rung 16 and a side rail segment 12. A suitable lock includes a sleeve 372 which is slidingly engaged on rung 16 and a flange 374 engaged on side rail segment 12. Preferably flange 374 is formed as a projection on bearing member 330. Flange 374 extends out from the side rail and is positioned such that it does not interfere with the folding of the ladder. Flange 374 is further positioned such that it will overlie rung 16 when side rail segment 12 is rotated about 90°, for use, as shown in FIG. 8B. In this position, sleeve 372 can be moved along rung 16 into position over flange 374, to engage flange 374 and lock side rail segment 12, and thereby the entire side rail, into position relative to rung 16. A spring actuated push button 380 is preferably provided within rung 16 to extend partially through an aperture 382 formed in rung 16 to hold sleeve 372 in locking position over flange 374. To release sleeve 372 from locking position over flange 374, push button 380 is pressed and sleeve 372 is moved along rung 16. The side rail is then free to rotate into collapsible position.

Figure 9A:
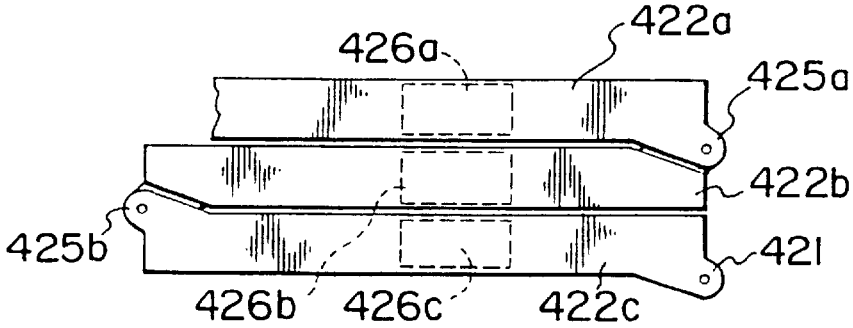
FIG. 9A shows a side view of another embodiment of a ladder according to the present invention in folded arrangement.
Figure 9B:
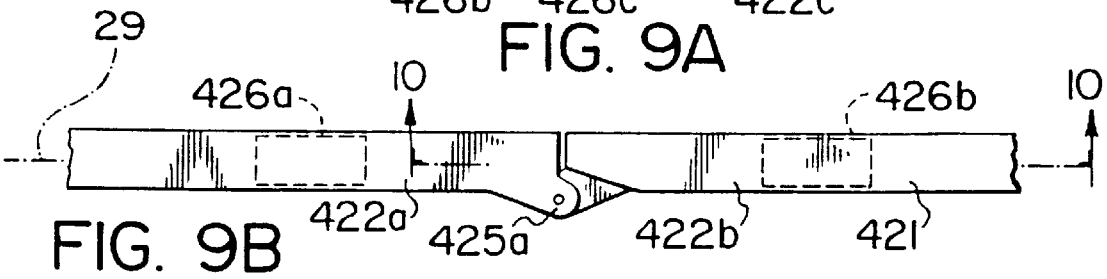
FIG. 9B shows a side view of the ladder of FIG. 9A in a flat arrangement.
Figure 9C:
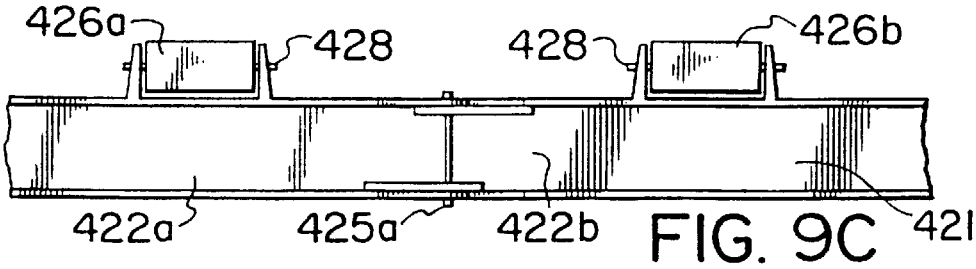
FIG. 9C shows a side view of the ladder of FIG. 9A in a position for use.

Referring to FIGS. 9A, 9B, 9C another embodiment of the present invention is shown. The ladder includes side rails 421 formed of segments 422*a*, 422*b*, 422*c*. The segments are formed as I-beams of any suitable material. As an example, suitable dimensions for a segment formed of fibre-glass reinforced nylon are: height 3", width 1.2" and web thickness of 0.1". In another example, the side rail has a web thickness of 0.25" and is formed of structural foam ABS plastic. The segments are joined at their abutting ends by means of a single hinge arrangement 425*a*, 425*b*. A plurality of rungs 426*a*, 426*b*, 426*c* (shown in phantom in FIGS. 9A and 9B) are pivotally connected between side rails 421 by means of single hinges 428 disposed at each end of each rung 426*a*, 426*b*, 426*c*. The ladder of this embodiment is prepared for use in the same way as that described in relation to FIG. 1A–1C.

Figure 10:
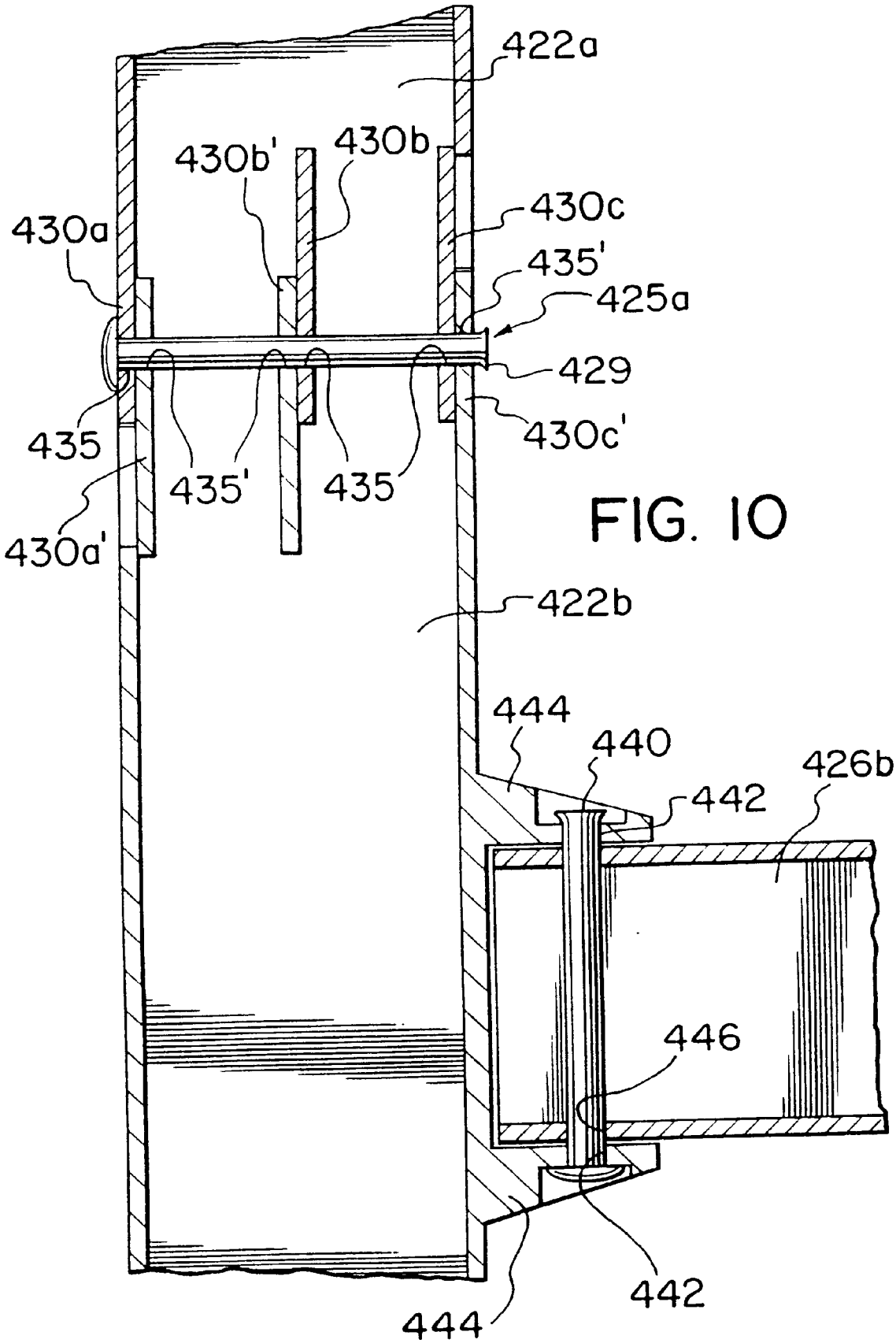
FIG. 10 is a sectional view along line 10—10 of FIG. 9B.

Referring also to FIG. 10 , side rail segments 422*a* and 422*b* are connected by single hinge 425*a*. Single hinge 425*a* includes a hinge pin 429 about which the segments pivot. Ribs 430*a*–430*c* extend out from the ends side rail segment 422*a* at the end thereof and have aligned apertures 435 formed therethrough segment 422*b* has similar ribs 430*a*', 430*b*' and 430*c*' with apertures 435'. Hinge pin is disposed through apertures 435, 435'. The edges of the ribs are curved to permit rotation about the pin. To permit segments 422*a* and 422*b* to be aligned along their length, ribs 430*a*–430*c* on segment 422*a* are offset from ribs 430*a*'–430*c*' on segment 422*b*. Preferably the ribs are formed integral with the segment, as shown. Alternatively, the ribs can be formed separately and attached to the segments by any suitable means. To permit aligned connection of all adjacent segments and ease of manufacture each segment is formed with a first defined end and a second defined end. The first defined end on a segment is shaped to hinge to any second defined end on another segment. As will be understood other arrangements and numbers of ribs can be used to obtain attached segments which can be pivoted relative to each other from a position in which they substantially abut to a position in which one segment is folded over the other in an accordance arrangement.

Rung 426*b* is pivotally attached to segment 422*b* by a pin 440 which passes through aligned apertures 442 formed in a bearing member 444 on segment 422*b* and an alignable aperture 446 formed through rung 426*b*. Bearing member 444 is preferably formed integral with the segment.

Figure 11:
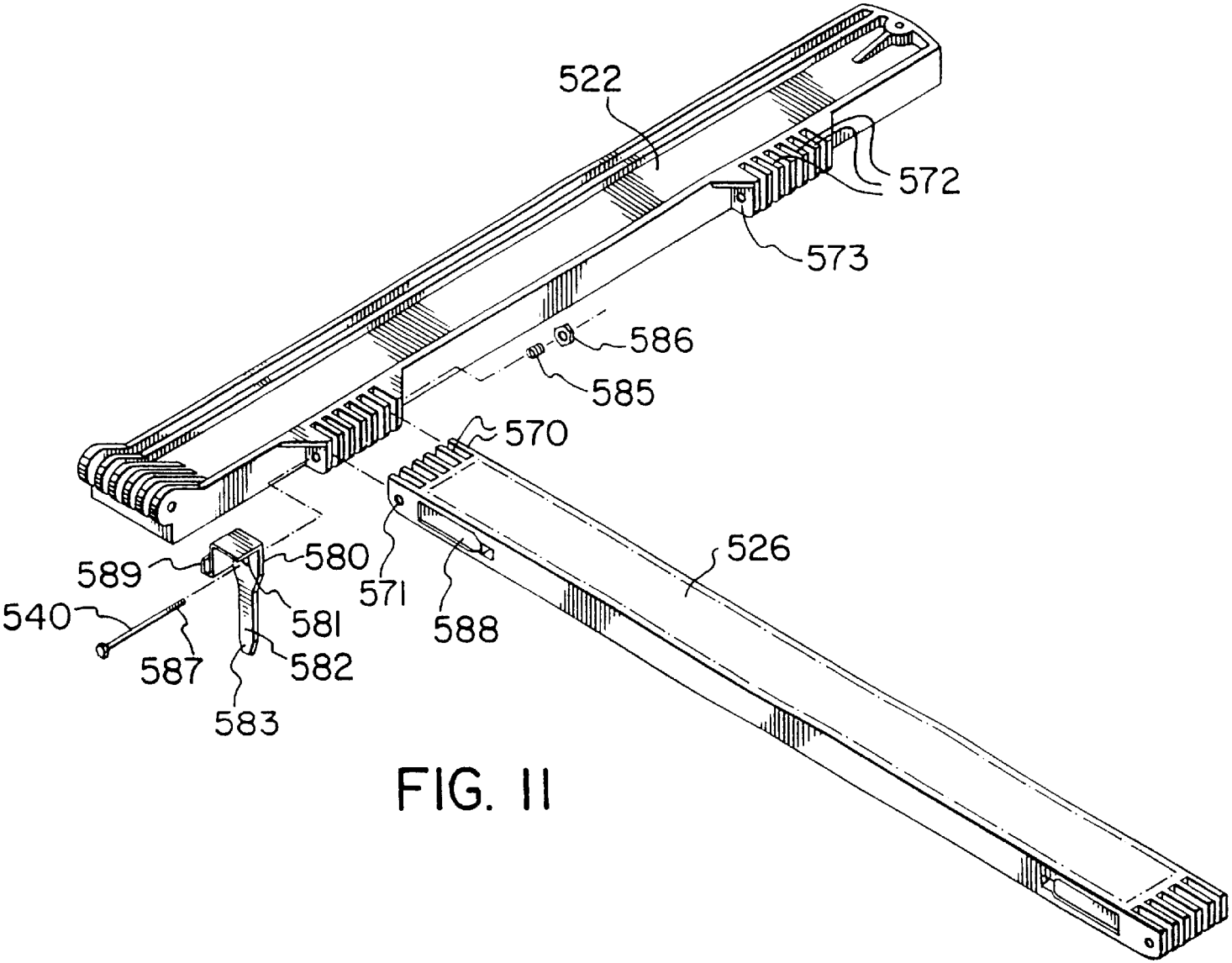
FIG. 11 is an exploded view of a ladder according to the present invention with a lock arrangement.
Figure 12:
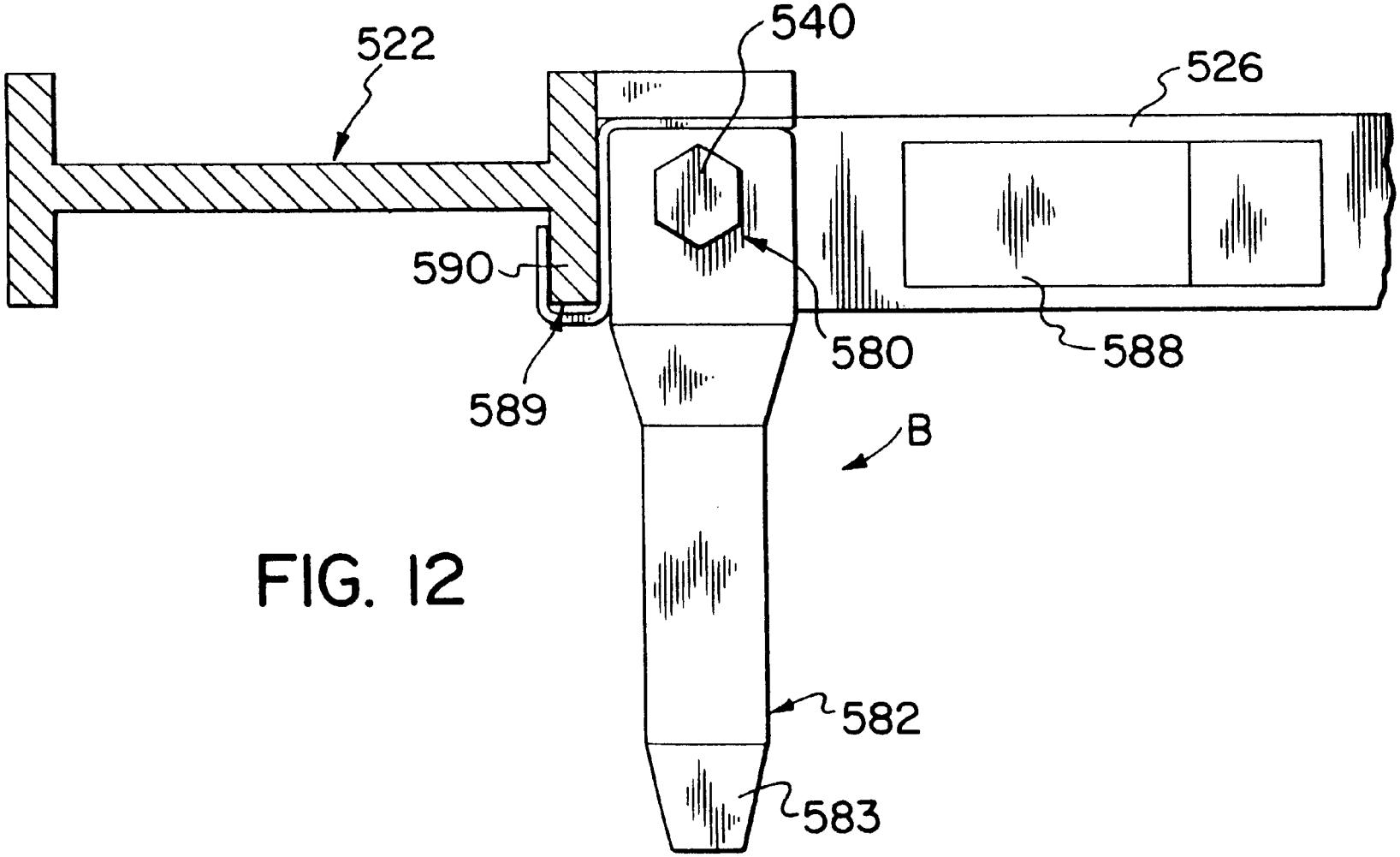
FIG. 12 is a schematic view of an end view of the lock arrangement of FIG. 11.

Referring to FIG. 11, another embodiment of the invention is shown wherein rung 526 has a plurality of ribs 570 formed on its ends. Each rib has one aperture 571 formed therethrough which is aligned with the apertures on the other ribs. Rail segment 522 also has formed thereon a plurality of ribs 572 with aligned apertures 573 therethrough. To connect rung 526 to segment 522, ribs 570 mesh with ribs 572 and a hinge pin 540 is inserted through the aligned apertures. Referring also to FIG. 12, another lock is shown for preventing the inadvertent rotation of the side rails into collapsible position during use. The lock acts at the hinge between side rail 522 and a rung 526 and includes a lock clip having a base portion 580 with an aperture 581 therethrough and an arm portion 582 extending from base portion 580.

Arm portion includes a hook 583. Arm portion 582 is preferably shaped, such as by bending, to extend in a plane offset from the plane defined by the base.

Clip is secured to the hinge to be locked by use of hinge pin 540 which is inserted through aperture 581. An enlarged portion on hinge pin 540 prevents the pin from passing through aperture 581. The clip is secured to remain in position with arm portion 582 extending out substantially orthogonally from the plane of the rail segment. Base portion 580 is shaped to prevent rotation of clip about hinge pin 540. A spring 585 is mounted at the opposite end of the hinge pin 540 and a bolt 586 is secured on a threaded portion 587 of hinge pin to retain spring 585 on hinge pin 540. Spring 585 acts between the hinge and bolt 586 to pull hinge pin 540 down such that the clip is maintained against the hinge.

The clip is mounted on the hinge such that the plane of defined by the arm portion is positioned toward the rung and hook portion 583 also extends towards the rung. Rung 526 has formed on its surface an indentation 588 shaped and positioned to accept arm portion 582 and hook 583. The clip acts to lock the side rails in a position wherein they extend out substantially orthogonally from the plane of the rungs. Spring 585 normally draws the clip toward the hinge. When rung 526 is rotated to a position orthogonal to the plane of the rail segment as shown by arrow B, arm portion 582 of the clip is forced up out of the way of rung 526 by compression of spring 585. The clip rides over the surface of rung 526 until it is drawn into indentation 588 in the rung. Spring 585 maintains arm portion 582 including hook 583, securely in indentation 588 which prevents further rotation of the rung.

When it is desired to return the ladder to a foldable position, force can be applied to hinge pin 540 to compress spring 585 and cause arm portion 582, including hook 583, to be displaced from indentation 588. Rung 526 is then free to be rotated.

Preferably, a guide flange 589 is formed on base portion 580 to maintain the clip in position and to guide the movement of the clip away from and toward the hinge during compression of spring 585. Guide flange 589 is formed to fold around and ride along an end wall 590 of the segment 522.

Preferably, hook 583 is tapered toward its end to facilitate the clips ability to ride over the surface of the rung when moving into the locking position. In a preferred embodiment, the clips are placed on the ladder such that they engage the upper surface of the rungs. In this way, should a person using the ladder step on the lock portion, this only causes the clip to be further forced into the indentation of the rung.

It will be apparent that many other changes may be made to the illustrative embodiments, while falling within the scope of the invention, and it is intended that all such changes be covered by the claims appended hereto.

The embodiments of the invention in which an exclusive property or privilege is claimed are defined as follows:

1. A ladder comprising a pair of side rails and a plurality of rungs, a hinge positioned between each rung and each of the side rails such that the side rails are free to rotate from positions substantially coplanar with the rungs to positions defining a plane substantially normal to the rungs to support the rungs, the hinges between the rungs and the side rails being disposed to permit relative rotation of the side rails not more than 90° from the position substantially coplanar to the rungs and each hinge including a plurality of ribs formed integral with the side rail and extending outwardly from a side thereof and a plurality of ribs formed integral with the rung at an end thereof, the ribs each having an aperture therethrough aligned with the apertures of adjacent ribs, the ribs of the rung being meshed with the ribs of the side rail with their apertures in alignment and a hinge pin extending through the aligned apertures, and the side rails being formed in segments attached at their ends by segment hinges such that the side rails can be folded into an accordion arrangement, the segment hinges each including a plurality of end ribs formed integral with the segments and extending outwardly from an end thereof each end rib having an aperture therethrough aligned with the apertures of adjacent end ribs, the end ribs of the segments being meshed with their apertures in alignment and a hinge pin extending through the aligned apertures, wherein an elastic cord is connected between at least one rung and each side rail adjacent the rung, the elastic cord being under tension and positioned to drive the side rails from the position substantially coplanar with the rung to the position wherein each side rail defines a plane substantially normal to the rung.

2. The ladder as defined in claim 1 wherein at least some of the hinges between the rungs and the side rails are formed to allow rotation substantially only about 90° from the position substantially coplanar with the rungs towards one of a front facing side of the ladder or a rear facing side of the ladder.

3. The ladder as defined in claim 1 wherein the rungs are formed to restrict rotation of the side rails about the rungs to substantially only about 90° from the position substantially coplanar with the rungs towards one of a front facing side of the ladder or a rear facing side of the ladder.

4. The ladder of claim 1 further comprising a lock for locking the ladder into an extended position.

5. The ladder of claim 4 wherein the lock is disposed between each side rail and at least one rung.

6. The ladder of claim 4 wherein the lock is selected to lock between the rung and the side rail automatically when the side rail is rotated from the position substantially coplanar with the rung to the position wherein each side rail defines a plane substantially normal to the rung.

7. The ladder of claim 6 wherein the lock includes a hook selected to engage into an indentation when the side rail is rotated to align the hook with the indentation.

8. The ladder of claim 7 wherein the hook is positioned on the side rail and the indentation is positioned on the upper surface of the rung.

9. A ladder comprising a pair of side rails and a plurality of rungs, a pivotal attachment being positioned between each rung and each of the side rails such that the side rails are free to rotate from positions substantially coplanar with the rungs to positions defining a plane substantially normal to the rungs to support the rungs, the pivotal attachment between the rungs and the side rails being disposed to permit relative rotation of the side rails not more than 90° from the position substantially coplanar to the rungs and the side rails being formed in segments, each segment having a width and being pivotally attached at their ends such that the side rails can be folded into an accordion arrangement and a lock disposed between each side rail and at least one rung to lock the side rail into the position defining a plane substantially normal to the rungs, the lock being selected to lock between the rung and the side rail automatically when the side rail is rotated from the position substantially coplanar with the rung to the position wherein each side rail defines a plane substantially normal to the rung, wherein an elastic cord is connected between at least one rung and each side rail adjacent the rung, the elastic cord being under tension and positioned to drive the side rails from the position substantially coplanar with the rung to the position wherein each side rail defines a plane substantially normal to the rung.

10. The ladder of claim 9 wherein the lock includes a hook selected to engage into an indentation when the side rail is rotated to align the hook with the indentation.

11. The ladder of claim 10 wherein the hook is positioned on the side rail and the indentation is positioned on the upper surface of the rung.

12. The ladder as defined in claim 9 wherein at least some of the pivotal attachments between the rungs and the side rails are formed to allow rotation substantially only about 90° from the position substantially coplanar with the rungs towards one of a front facing side of the ladder or a rear facing side of the ladder.

13. The ladder as defined in claim 9 wherein the rungs are formed to restrict rotation of the side rails about the rungs to substantially only about 90° from the position substantially coplanar with the rungs towards one of a front facing side of the ladder or a rear facing side of the ladder.

14. The ladder of claim 9 wherein the segments are pivotally attached by hinges including a plurality of ribs formed integral with the segments and extending outwardly from an end thereof, the ribs each having an aperture therethrough aligned with the apertures of adjacent ribs and a hinge pin extending therethrough.

15. The ladder of claim 9 wherein the pivotally attachments between the rungs and the side rails are each hinges including a plurality of ribs formed integral with the side rail and extending outwardly from a side thereof and a plurality of ribs formed integral with the rung and extending outwardly from an end thereof, the ribs each having an aperture therethrough aligned with the apertures of adjacent ribs, the ribs of the rung being meshed with the ribs of the segment with their apertures in alignment and a hinge pin extending through the aligned apertures.

* * * * *